US007621158B2

(12) United States Patent
Roepke et al.

(10) Patent No.: US 7,621,158 B2
(45) Date of Patent: Nov. 24, 2009

(54) WASHING MACHINE AND COUPLING APPARATUS

(75) Inventors: Jon Arthur Roepke, Milford, MA (US); Joshua Paul Kopecky, Louisville, KY (US); Derek Lee Watkins, Elizabethtown, KY (US); Mark Aaron Weaver, Crestwood, KY (US); Christopher Gregory Hoppe, Louisville, KY (US); Bertram Joseph Stocker, Jr., Fisherville, KY (US)

(73) Assignee: General Electric Company, Schenctady, NY (US)

( * ) Notice: Subject to any disclaimer, the term of this patent is extended or adjusted under 35 U.S.C. 154(b) by 637 days.

(21) Appl. No.: 10/873,006

(22) Filed: Jun. 22, 2004

(65) Prior Publication Data

US 2005/0278869 A1 Dec. 22, 2005

(51) Int. Cl.
*D06F 7/00* (2006.01)

(52) U.S. Cl. ..... 68/132; 8/159; 68/133; 192/69.7; 192/69.9; 192/84.92

(58) Field of Classification Search ..... 8/159; 68/132, 133; 192/69.7, 69.9, 84.92
See application file for complete search history.

(56) References Cited

U.S. PATENT DOCUMENTS

| | | | | |
|---|---|---|---|---|
| 3,375,685 | A * | 4/1968 | Scott | 68/12.11 |
| 4,255,952 | A * | 3/1981 | Johnson | 68/23.7 |
| 5,720,190 | A | 2/1998 | Johnson et al. | |
| 6,202,451 | B1 | 3/2001 | Park et al. | |
| 6,332,343 | B1 | 12/2001 | Koketsu et al. | |
| 6,460,382 | B1 | 10/2002 | Kim et al. | |
| 2002/0166349 | A1 * | 11/2002 | Lim et al. | 68/23.7 |
| 2003/0056554 | A1 * | 3/2003 | Ahn | 68/12.24 |

* cited by examiner

*Primary Examiner*—Frankie L Stinson
*Assistant Examiner*—Samuel A Waldbaum
(74) *Attorney, Agent, or Firm*—George L. Rideout, Esq.; Armstrong Teasdale LLP

(57) ABSTRACT

A coupling apparatus includes an inner shaft rotatably driven about a longitudinal axis of rotation, an outer shaft concentric with the inner shaft for selective rotation about the longitudinal axis, a coupling element movable between a first position engaging the inner shaft to the outer shaft for rotation therewith, and a second position disengaging the inner shaft from the outer shaft for relative rotation therebetween, and an actuating element connected to the coupling element and operable to move the coupling element between the first position and the second position.

19 Claims, 8 Drawing Sheets

WASHING MACHINE AND COUPLING APPARATUS

BACKGROUND OF THE INVENTION

This invention relates generally to washing machines and, more specifically, to a mechanism for coupling and de-coupling appropriate elements of a washing machine during selected portions of the wash cycle.

At least some known washing machines typically include a perforated basket for holding clothing or other articles to be washed, an agitator disposed within the basket which agitates the clothes in the basket, and a motor which drives the agitator and the basket. The articles to be washed are immersed in water with detergent and washed under the influence of an oscillating agitator. After agitation, the articles are rinsed with clean water and the basket is spun at sufficient speed to centrifugally extract the rinse water from the articles.

Generally, the agitator and basket are mounted on concentric shafts with the agitator shaft internal to the basket shaft. During agitation, the basket and basket shaft are motionless while the agitator shaft and agitator are free to oscillate to impart a cleaning action to the articles being washed. During spin cycles, the agitator shaft and basket shaft are engaged so that the agitator and basket spin in concert with no relative motion between the two. The coupling and uncoupling of the agitator and basket shafts is usually controlled by the mechanical drive system. However, the drive system could be simpler and less costly to manufacture if the coupling of the basket and agitator was controlled by a separate system.

BRIEF DESCRIPTION OF THE INVENTION

In one aspect, a coupling apparatus includes an inner shaft rotatably driven about a longitudinal axis of rotation, an outer shaft concentric with the inner shaft for selective rotation about the longitudinal axis, a coupling element movable between a first position engaging the inner shaft to the outer shaft for rotation therewith, and a second position disengaging the inner shaft from the outer shaft for relative rotation therebetween, and an actuating element connected to the coupling element and operable to move the coupling element between the first position and the second position.

In another aspect, a washing machine includes a wash tub, a perforated basket rotatably mounted within the tub, an agitation element disposed within the basket to agitate articles, an outer shaft connected to the basket to drive the basket, an inner shaft connected to the agitation element to drive the agitation element, a motor drivingly connected to the inner shaft, and a coupling mechanism to selectively couple the inner shaft and the outer shaft.

In another aspect, a method of coupling and de-coupling a shaft driven agitation element and basket in a washing machine, the agitation element being driven by an inner shaft and the basket being driven by an outer shaft, includes disposing the inner shaft within the outer shaft so that the inner and outer shafts share a common axis of rotation, providing a coupling element concentric with the inner and outer shafts movable between a first position engaging the outer shaft with the inner shaft for rotation therewith and a second position disengaging the shafts for relative motion therebetween, driving the inner shaft, and moving the coupling element between the first and second positions based on a portion of a wash cycle.

DETAILED DESCRIPTION OF THE INVENTION

Figure 1:
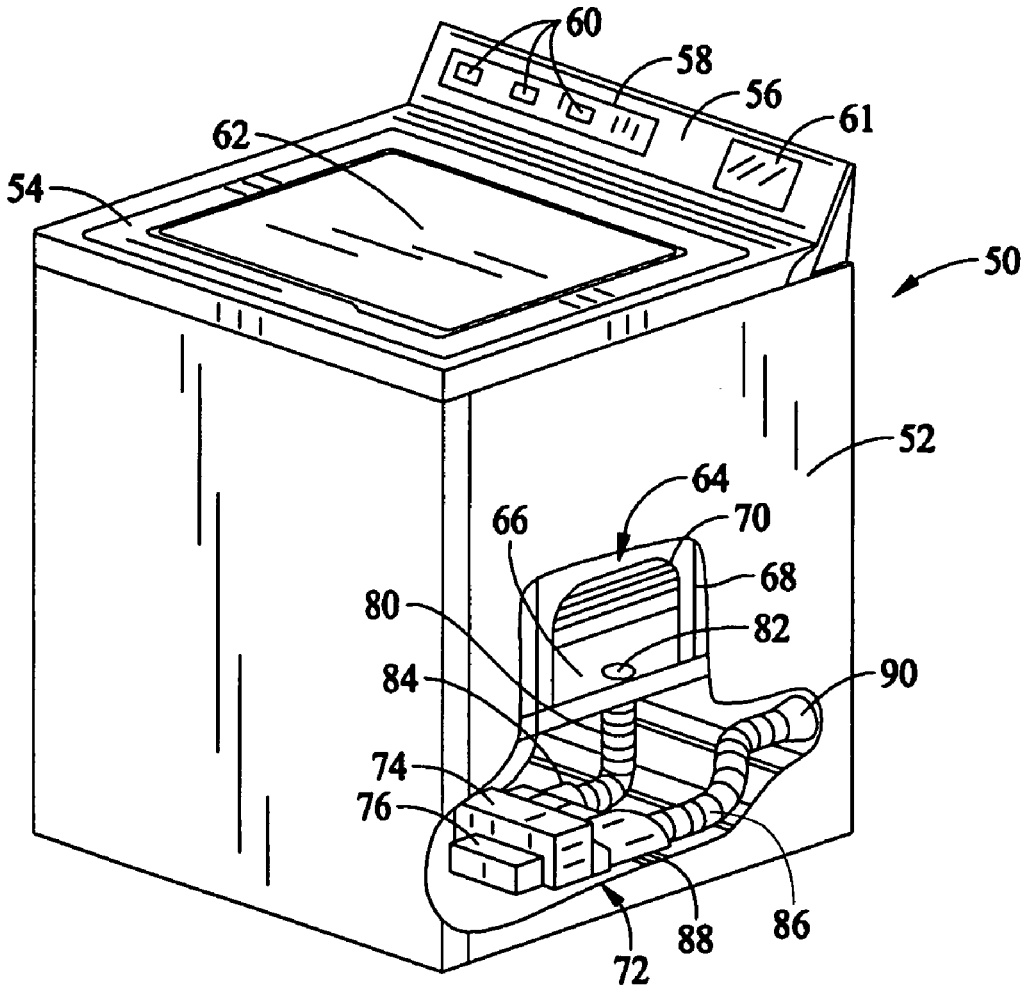
FIG. 1 is a perspective view partially broken away of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming an enclosure over wash tub 64. As illustrated in FIG. 1, machine 50 is a vertical axis washing machine.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
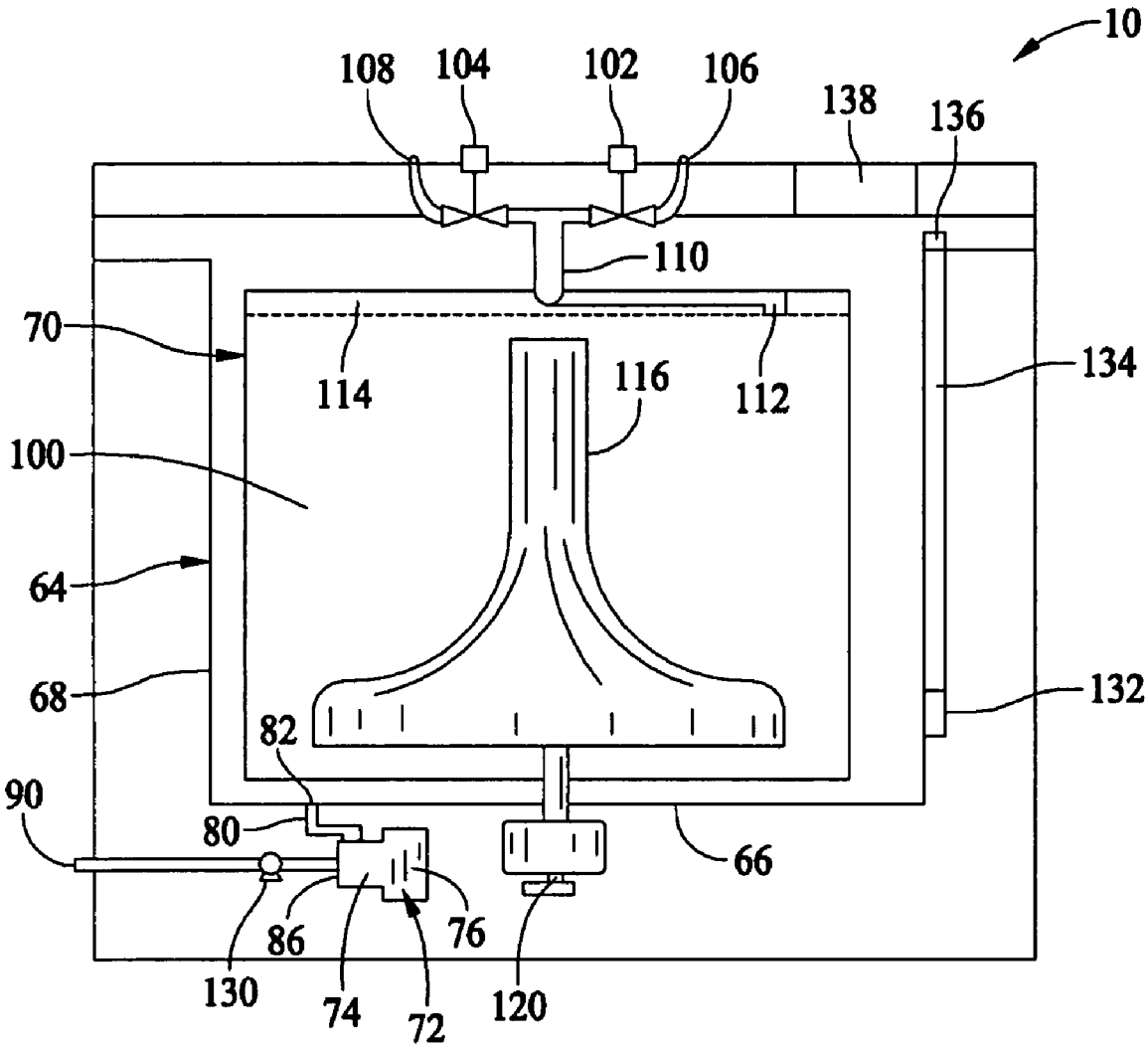
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

In an alternative embodiment, a spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

An agitation element 116, such as a vane agitator, impeller, auger, nutator, infuser, or oscillatory basket mechanism, or some combination thereof is disposed in basket 70 to impart an oscillatory motion to articles and liquid in basket 70.

A wash cycle generally includes one or more agitation cycles alternated with one or more spin cycles. During agitation, agitation element 116 oscillates imparting a cleaning action to items being washed. During agitation, basket 70 is stationary. During the spin cycles, agitation element 116 and basket 70 rotate together with no relative motion therebetween.

Figure 3:
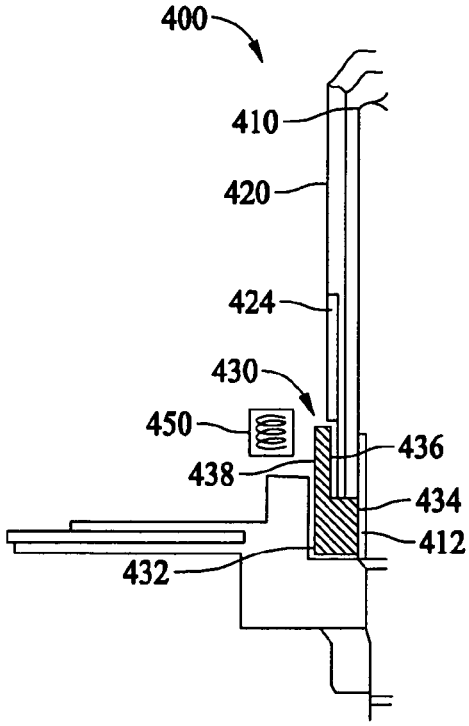
FIG. 3 is a left half cross sectional view of one embodiment of a coupling and de-coupling mechanism with the coupling disengaged.
Figure 4:
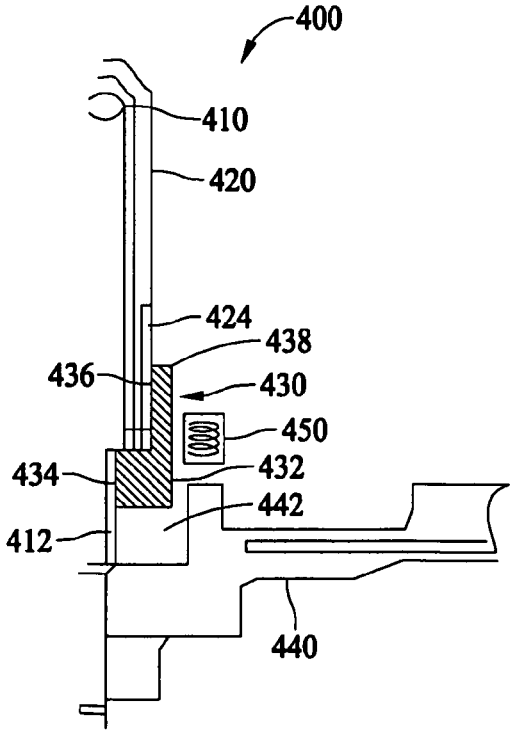
FIG. 4 is a right half cross sectional view of the coupling of FIG. 3 with the coupling engaged.

FIG. 3 illustrates a left half cross sectional view of one embodiment of a coupling and de-coupling mechanism 400 to control the relative movements of agitation element 116 and basket 70 of washing machine 50. In FIG. 3, coupling mechanism 400 is disengaged. FIG. 4 illustrates a right half cross sectional view of the coupling and de-coupling mechanism of FIG. 3, where the coupling is engaged. Coupling and de-coupling mechanism 400 operates on inner shaft 410 and an outer shaft 420. Inner shaft 410 is internal to and concentric with outer shaft 420. Inner shaft 410 is connected to and driven by a rotor 440. Rotor 440 includes a central recessed portion 442 that receives a cylindrical coupler 430. Coupler 430 includes a lower portion 432 including a plurality of first splines 434 configured to engage a plurality of external splines 412 on inner shaft 410. Coupler 430 is free to slide along inner shaft external splines 412. Coupler 430 includes an upper portion 438 that includes a plurality of second splines 436 configured to engage a plurality of external splines 424 on outer shaft 420. An actuator 450 moves coupler 430 along inner shaft external splines 412.

Coupler 430 moves up and down inner shaft external splines 412 to engage and disengage inner shaft 410 with outer shaft 420. During agitation, inner shaft 410 and outer shaft 420 are disengaged as shown in FIG. 3. In FIG. 4, coupler 430 rests in recess 442 of rotor 440 so that second splines 436 on coupler upper portion 438 are not engaged with external splines 424 on outer shaft 420. Inner shaft 410 is thus free to move relative to outer shaft 420. During spin cycles, actuator 450 moves coupler 430 upward along inner shaft 410 to engage external splines 424 on outer shaft 420 as illustrated in FIG. 4. In this position, inner shaft 410 and outer shaft 420 are engaged so that outer shaft 420 is driven by inner shaft 410 for simultaneous rotation during the spin cycle. In one embodiment, actuator 450 is a solenoid that is controlled by a controller coupled to control panel 58. In alternative embodiments, actuator 450 includes an electric motor, a spring, or a wax motor.

In the embodiments of FIGS. 3 and 4, the mating geometry between the coupling and shaft members is only in the shaft members with no special rotor bushing or boss design required to mesh the coupler in the engaged or disengaged positions. This allows the coupler to be designed to occupy a smaller space.

Figure 5:
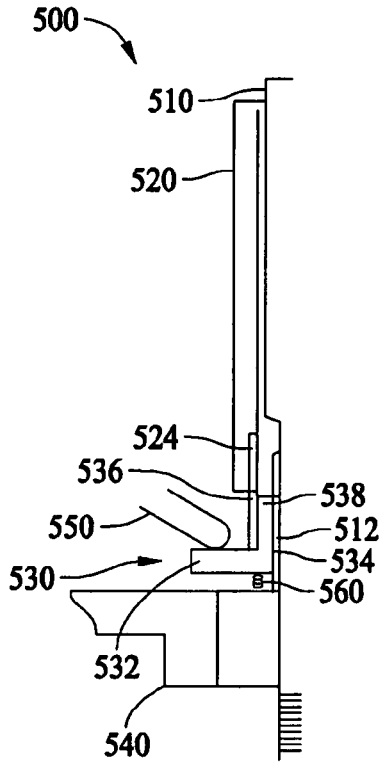
FIG. 5 is a left half cross sectional view of another embodiment of a coupling and de-coupling mechanism with the coupling disengaged.
Figure 6:
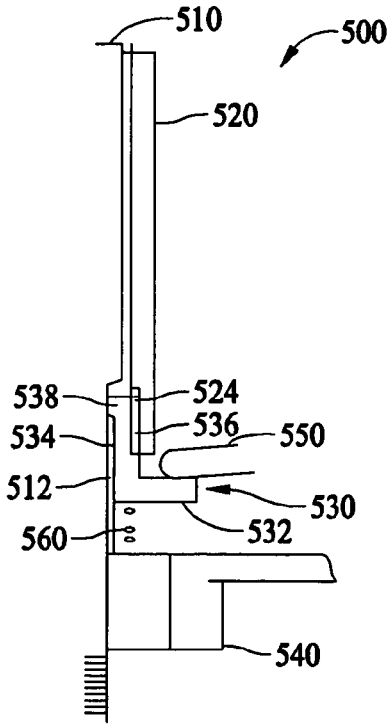
FIG. 6 is a right half cross sectional view of the coupling of FIG. 5 with the coupling engaged.

FIG. 5 illustrates a left half cross sectional view of another embodiment of a coupling and de-coupling mechanism 500 to control the relative movements of agitation element 116 and basket 70 of washing machine 50. In FIG. 5, coupling mechanism 500 is disengaged. FIG. 6 illustrates a right half cross sectional view of the coupling and de-coupling mechanism of FIG. 5, where the coupling is engaged. Coupling and de-coupling mechanism 500 operates on inner shaft 510 and a outer shaft 520. Inner shaft 510 is internal to and concentric with outer shaft 520. Inner shaft 510 is connected to and driven by a rotor 540. A coupler 530 includes a lower portion 532 and an upper portion 538. Coupler 530 is concentric with inner shaft 510 and outer shaft 520. Upper portion 538 of coupler 530 includes a plurality of internal splines 534 configured to engage a plurality of external splines 512 on inner shaft 510. Upper portion 538 of coupler 530 includes a plurality of external splines 536 configured to engage a plurality of internal splines 524 on outer shaft 520. Coupler 530 is free to slide along inner shaft splines 512. An actuator 550 moves coupler 530 downward along inner shaft 510 on splines 512. A biasing member 560 biases coupler 530 in an upward position. In one embodiment, biasing member 560 is a spring.

Coupler 530 moves up and down inner shaft splines 512 to engage and disengage inner shaft 510 with outer shaft 520. During agitation, inner shaft 510 and outer shaft 520 are disengaged as shown in FIG. 5. In FIG. 5, coupler 530 is held in a downward position under the influence of actuator 550 against biasing member 560. In this position, splines 536 on coupler upper portion 538 are not engaged with splines 524 on outer shaft 520. Inner shaft 510 is thus free to move relative to outer shaft 520. During spin cycles, actuator 550 is pivoted upward allowing biasing member 560 to force coupler 530 upward along inner shaft 510 to engage splines 524 on outer shaft 520 as illustrated in FIG. 6. In this position, inner shaft 510 and outer shaft 520 are engaged so that outer shaft 520 is driven by inner shaft 510 for simultaneous rotation during the spin cycle.

In the embodiments of FIGS. 5 and 6, the mating geometry between the coupling and shaft members is only in the shaft members with no special rotor bushing or boss design required to mesh the coupler in the engaged or disengaged positions. This allows the coupler to be designed to occupy a smaller space. In addition, the transfer of torque from the internal member between the shafts takes place in the same plane, effectively decreasing coupler flexure.

Figure 7:
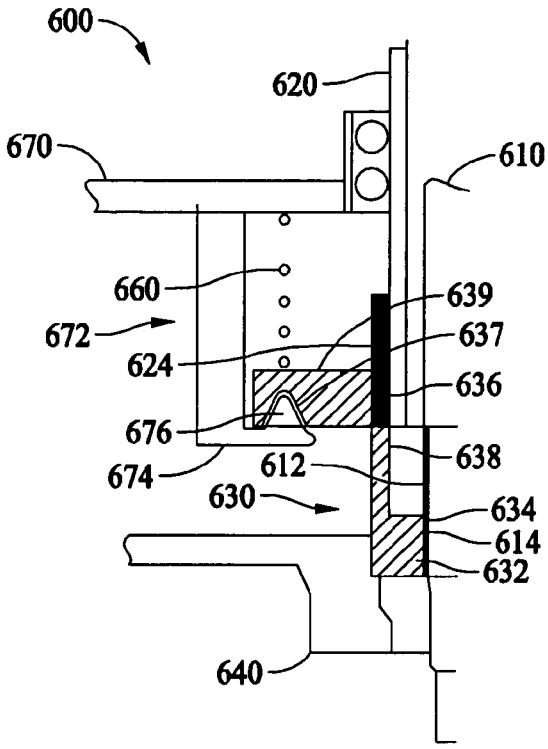
FIG. 7 is a left half cross sectional view of another embodiment of a coupling and de-coupling mechanism with the coupling disengaged.
Figure 8:
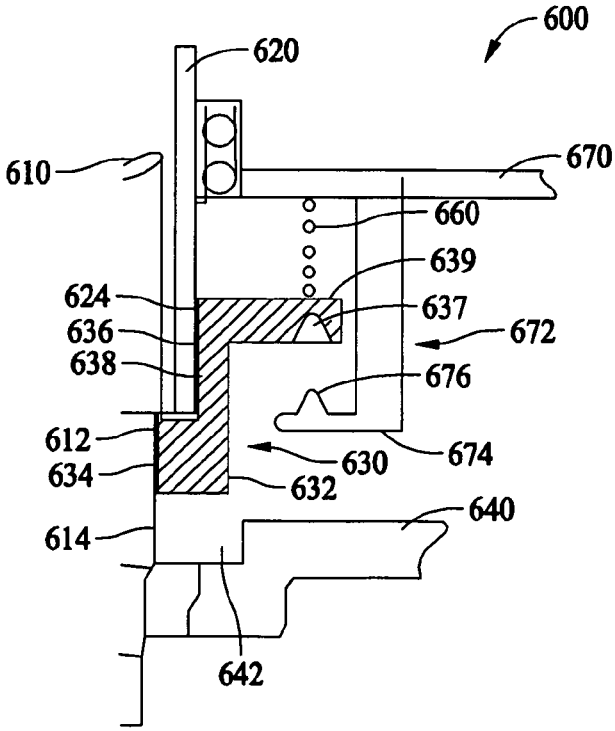
FIG. 8 is a right half cross sectional view of the coupling of FIG. 7 with the coupling engaged.

FIG. 7 illustrates a left half cross sectional view of another embodiment of a coupling and de-coupling mechanism 600 to control the relative movements of agitation element 116 and basket 70 of washing machine 50. In FIG. 7, coupling mechanism 600 is disengaged. FIG. 8 illustrates a right half cross sectional view of the coupling and de-coupling mechanism of FIG. 7, where the coupling is engaged. Coupling and de-coupling mechanism 600 operates on inner shaft 610 and a outer shaft 620. Inner shaft 610 is internal to and concentric with outer shaft 620. Inner shaft 610 is connected to and driven by a rotor 640. A cylindrical coupler 630 includes a lower portion 632, an upright portion 638, and a locking arm 639 extending radially outward from upright portion 638. In one embodiment, coupler 630 includes at least two locking arms 639 to facilitate balancing of the mechanism. Locking arm 639 includes a locking notch 637. Coupler 630 is concentric with inner shaft 610 and outer shaft 620. Upright portion 638 of coupler 630 includes a plurality of internal splines 636 at an upper end thereof. Splines 636 are configured to engage a plurality of external splines 624 on outer shaft 620. Lower portion 632 of coupler 630 includes a plurality of internal splines 634 configured to engage a plurality of external splines 612 on inner shaft 610. Coupler 630 is free to slide along outer shaft splines 624. Rotor 640 includes a central recessed portion 642 that receives lower portion 632 of coupler 630 when coupler 630 is at the lower end of its travel. Inner shaft 610 includes a spline free section 614 adjacent rotor recess 642 such that coupler 630 is disengaged from inner shaft 610 when coupler 630 is seated in rotor recess 642. A coupler plate 672 is connected to the washer tub 670 and includes an arm 674 that includes a locking member 676. Locking member 676 is configured to be received in locking notch 637 of locking arm 639. A biasing member 660 is positioned between tub 670 and locking arm 639. Biasing member 660 operates to bias coupler 630 toward rotor recess 642. In one embodiment, biasing member 660 is a spring.

Coupler 630 moves up and down outer shaft splines 624 to engage and disengage inner shaft 610 with outer shaft 620. During agitation, inner shaft 610 and outer shaft 620 are disengaged as shown in FIG. 7. In FIG. 7, coupler 630 is held in a downward position by biasing member 660. In this position, splines 634 on coupler lower portion 632 are not engaged with splines 612 on inner shaft 610. Inner shaft 610 is thus free to move relative to outer shaft 620 while locking member 676 is received in locking notch 637 to hold outer shaft 620 stationary. During spin cycles, an actuator (not shown in FIGS. 7 and 8) moves coupler 630 upward against biasing member 660 so that splines 634 on coupler 630 engage splines 612 on inner shaft 610 as illustrated in FIG. 8. In this position, inner shaft 610 and outer shaft 620 are engaged so that outer shaft 620 is driven by inner shaft 610 for simultaneous rotation during the spin cycle. In another embodiment, inner shaft 610 is configured with splines 612 and spline free section 614 switched, positioning splines 612 adjacent rotor recess 642 and the relative positions of coupling arm 674 and locking arm 639 are reversed so that the agitate and spin positions of coupler 630 are reversed. That is, agitation occurs when coupler 630 is elevated and spin occurs when coupler 630 is lowered.

In the embodiments of FIGS. 7 and 8, the mating geometry between the coupling and shaft members is only in the shaft members with no special rotor bushing or boss design required to mesh the coupler in the engaged or disengaged positions. Rotation of one shaft is inhibited while the other shaft is mobilized.

Figure 9:
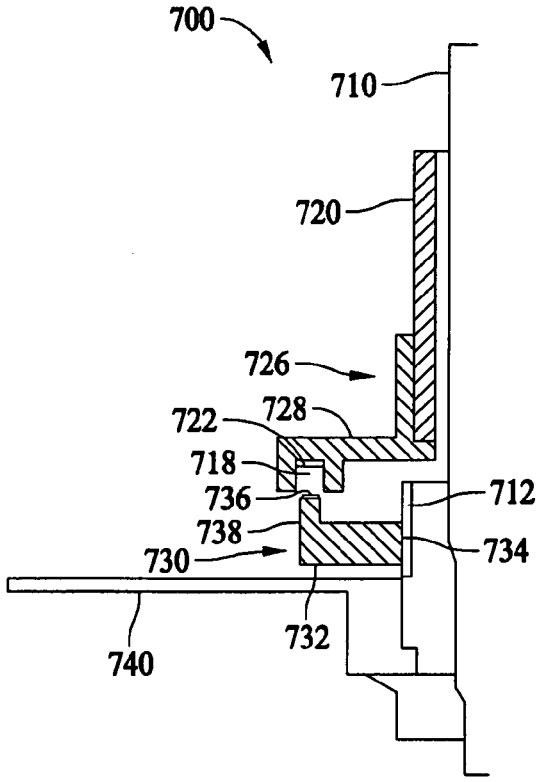
FIG. 9 is a left half cross sectional view of yet another embodiment of a coupling and de-coupling mechanism with the coupling disengaged.
Figure 10:
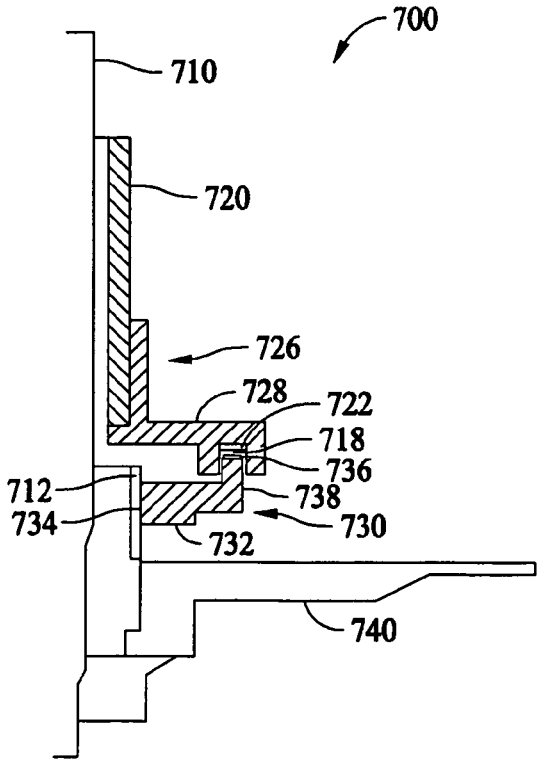
FIG. 10 is a right half cross sectional view of the coupling of FIG. 9 with the coupling engaged.

FIG. 9 illustrates a left half cross sectional view of yet another embodiment of a coupling and de-coupling mechanism 700 to control the relative movements of agitation element 116 and basket 70 of washing machine 50. In FIG. 9, coupling mechanism 700 is disengaged. FIG. 10 illustrates a right half cross sectional view of the coupling and de-coupling mechanism of FIG. 9, where the coupling is engaged. Coupling and de-coupling mechanism 700 operates on inner shaft 710 and a outer shaft 720. Inner shaft 710 is internal to and concentric with outer shaft 720. Inner shaft 710 is connected to and driven by a rotor 740. A cylindrical coupler 730 includes a lower portion 732 including a plurality of splines 734 configured to engaged a plurality of external splines 712 on inner shaft 710. Coupler 730 is free to slide along inner shaft splines 712. Coupler 730 includes an upwardly projecting rim 738 that includes teeth 736. A hub 726 is attached to the lower end of outer shaft 720 and includes a flange 728 that includes a downwardly facing channel 718 that includes teeth 722 configured for engagement with teeth 736 on coupler rim 738. An actuator (not shown in FIGS. 9 and 10) moves coupler 730 along inner shaft splines 712.

Coupler 730 moves up and down inner shaft splines 712 to engage and disengage inner shaft 710 with outer shaft 720. During agitation, inner shaft 710 and outer shaft 720 are disengaged as shown in FIG. 9. In FIG. 9, coupler 730 is moved downward on inner shaft 710 so that teeth 736 on coupler rim 738 are not engaged with teeth 722 on flange 728. Inner shaft 710 is thus free to move relative to outer shaft 720. During spin cycles, coupler 730 is moved upward along inner shaft splines 712 so that coupler rim teeth 736 engage teeth 722 on flange 728 as illustrated in FIG. 10. In this position, inner shaft 710 and outer shaft 720 are engaged so that outer shaft 720 is driven by inner shaft 710 through hub 726 for simultaneous rotation during the spin cycle.

In the embodiments of FIGS. 9 and 10, spline-to-spline misalignment failure during the coupling process is reduced. In addition, there is a lower force on the coupler geometry due to the larger radial interface point of mating.

Figure 11:
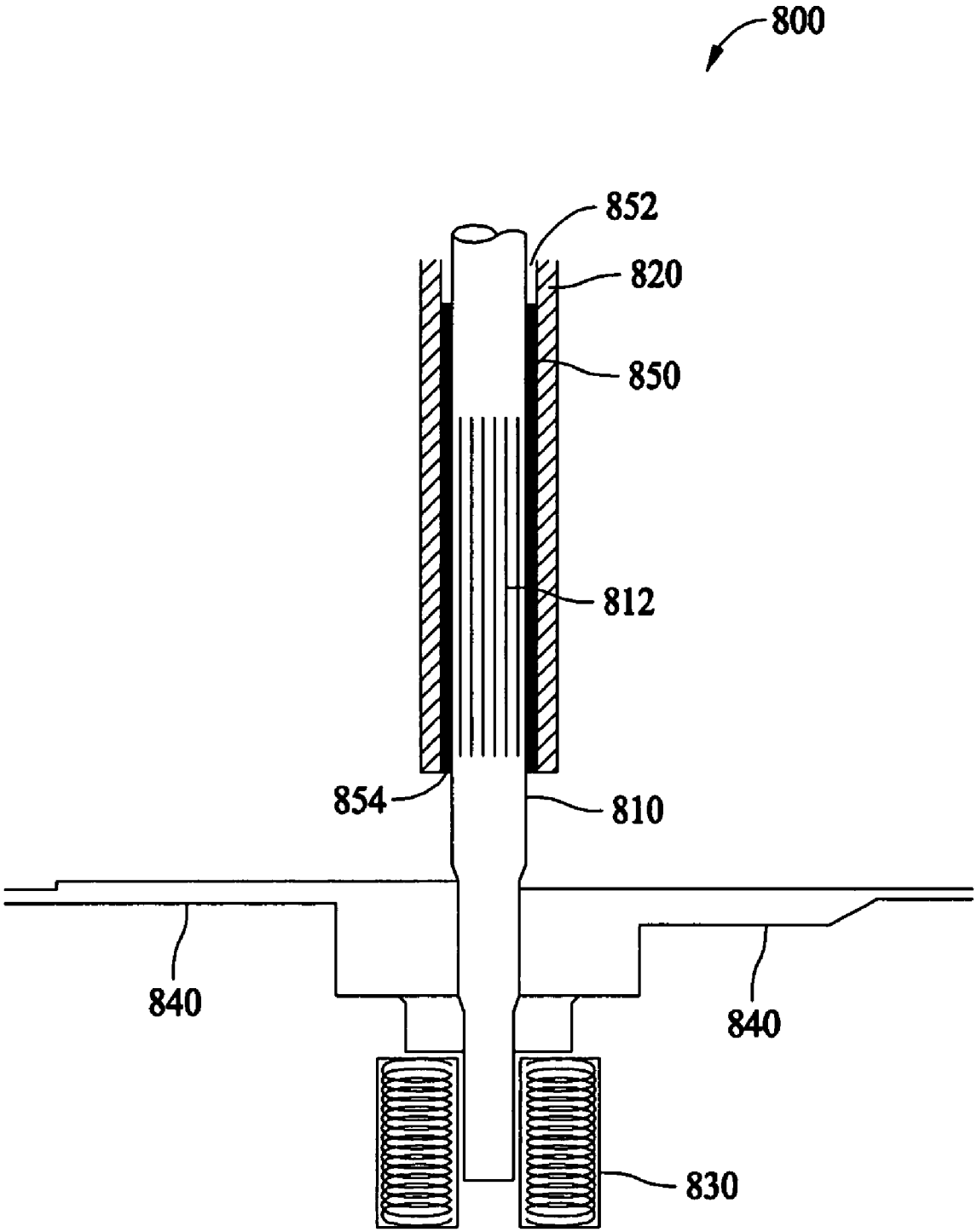
FIG. 11 is a cross sectional view of another embodiment of a coupling and de-coupling mechanism.

In another embodiment, a coupling and de-coupling mechanism 800 to control the relative movements of agitation element 116 and basket 70 of washing machine 50 is illustrated in FIG. 11. Coupling and de-coupling mechanism 800 operates on an inner shaft 810 and a outer shaft 820. Inner shaft 810 is internal to and concentric with outer shaft 820. Inner shaft 810 is connected to and driven by a rotor 840. Inner shaft 810 includes a plurality of external splines 812 around a lower portion thereof. A magnetic fluid 850 fills the lower portion of a space 852 between inner shaft 810 and outer shaft 820. A seal 854 seals the lower end of space 852 to retain fluid 850. An electromagnet 830 at the base of inner shaft 810 is energized or de-energized to control the viscosity of magnetic fluid 850.

During agitation, electromagnet 830 is not energized. When electromagnet 830 is not energized, the viscosity of magnetic fluid 850 is sufficiently low that splines 812 of inner shaft 810 do not grip magnetic fluid 850 so that relative motion between inner shaft 810 and outer shaft 820 takes place. During spin cycles, electromagnet 830 is energized increasing the viscosity of magnetic fluid 850 such that splines 812 grip magnetic fluid 850 so that inner shaft 810 and outer shaft 820 both rotate.

The embodiments of FIG. 11 do not entail the use of levers or mechanical actuating devices while offering variable coupling force and space savings.

Figure 12:
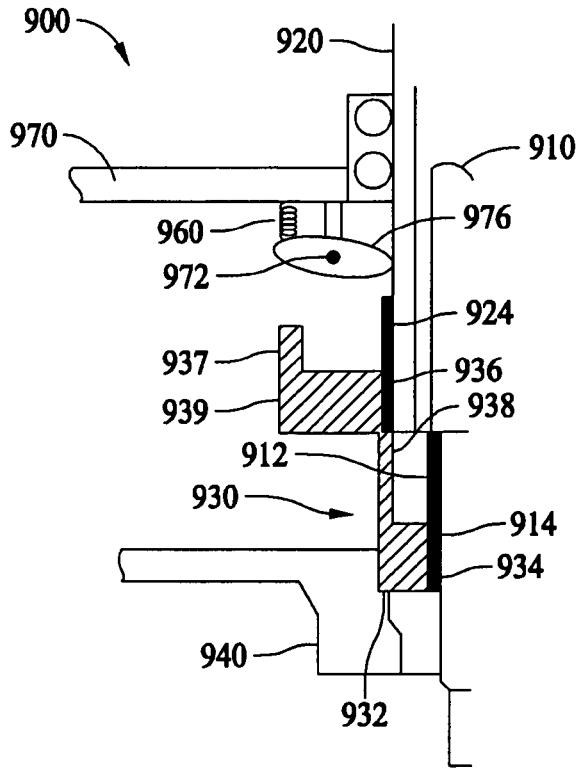
FIG. 12 is a left half cross sectional view of another embodiment of a coupling and de-coupling mechanism with the coupling disengaged.
Figure 13:
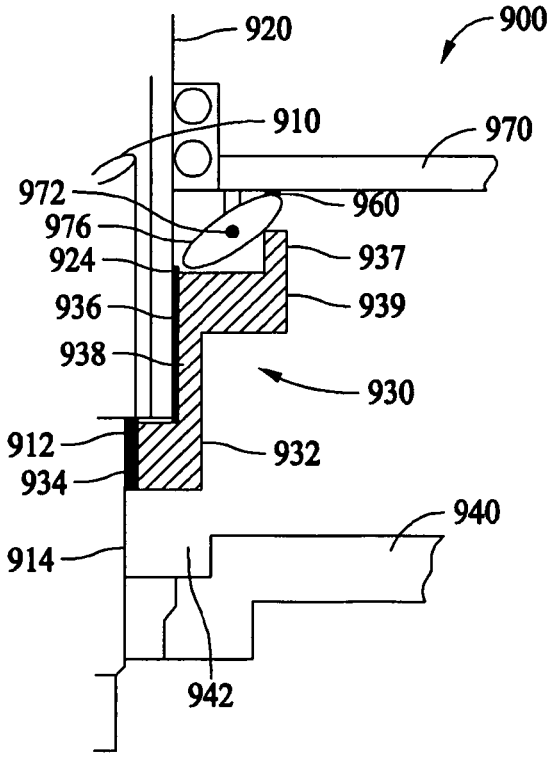
FIG. 13 is a right half cross sectional view of the coupling of FIG. 12 with the coupling engaged.

FIG. 12 illustrates a left half cross sectional view of another embodiment of a coupling and de-coupling mechanism 900 to control the relative movements of agitation element 116 and basket 70 of washing machine 50. In FIG. 12, coupling mechanism 900 is disengaged. FIG. 13 illustrates a right half cross sectional view of the coupling and de-coupling mechanism of FIG. 12, where coupling mechanism 900 is engaged. Coupling and de-coupling mechanism 900 operates on inner shaft 910 and a outer shaft 920. Inner shaft 910 is internal to and concentric with outer shaft 920. Inner shaft 910 is connected to and driven by a rotor 940. A cylindrical coupler 930 includes a lower portion 932, an upright portion 938, and a locking flange 939 extending radially outward from upright portion 938. Locking flange 939 includes an upwardly extending locking rim 937. Coupler 930 is concentric with inner shaft 910 and outer shaft 920. Upright portion 938 of coupler 930 includes a plurality of internal splines 936 at an upper end thereof. Splines 936 are configured to engage a plurality of external splines 924 on outer shaft 920. Lower portion 932 of coupler 930 includes a plurality of internal splines 934 configured to engage a plurality of external splines 912 on inner shaft 910. Coupler 930 is free to slide along outer shaft splines 924. Rotor 940 includes a central recessed portion 942 that receives lower portion 932 of coupler 930 when coupler 930 is at the lower end of its travel. Inner shaft 910 includes a spline free section 914 adjacent rotor recess 942 such that coupler 930 is disengaged from inner shaft 910 when coupler 930 is seated in rotor recess 942. A number of locking pawls 976 are pivotably attached to washer tub 970 through a plurality of pivot pins 972. Locking rim 937 is configured to engage an outer edge of locking pawls 976. Biasing member 960 is positioned between tub 970 and locking pawls 976. Biasing member 960 operates to bias locking pawls 976 into engagement with outer shaft 920 holding outer shaft 920 stationary. In one embodiment, biasing member 960 is a spring.

Coupler 930 moves up and down outer shaft splines 924 to engage and disengage inner shaft 910 with outer shaft 920. During agitation, inner shaft 910 and outer shaft 920 are disengaged as shown in FIG. 12. In FIG. 12, an actuator (not shown in FIGS. 12 and 13) moves coupler 930 to a downward position with coupler lower portion 932 within rotor recess 942. In this position, splines 934 on coupler lower portion 932 are not engaged with splines 912 on inner shaft 910. Inner shaft 910 is thus free to move relative to outer shaft 920. Locking pawls 976 are engaged with outer shaft 920 to hold outer shaft 920 stationary. During spin cycles, an actuator (not shown in FIGS. 12 and 13) moves coupler 930 upward against biasing member 960 so that splines 934 on coupler 930 engage splines 912 on inner shaft 910 as illustrated in FIG. 13. In this position, inner shaft 910 and outer shaft 920 are engaged so that outer shaft 920 is driven by inner shaft 910 for simultaneous rotation during the spin cycle. Locking rim 937 engages locking pawls 976 urging pawls 976 to pivot downward freeing outer shaft 920 for rotation.

In the embodiments of FIGS. 12 and 13, the mating geometry between the coupling and shaft members is only in the shaft members with no special rotor bushing or boss design required to mesh the coupler in the engaged or disengaged positions. Rotation of one shaft is inhibited while the other shaft is mobilized.

While the invention has been described in terms of various specific embodiments, those skilled in the art will recognize that the invention can be practiced with modification within the spirit and scope of the claims.

What is claimed is:

1. A coupling apparatus comprising:

an inner shaft rotatably driven about a longitudinal axis of rotation, said inner shaft comprising a plurality of inner shaft external splines;

an outer shaft concentric with said inner shaft for selective rotation about said longitudinal axis, said outer shaft configured to be rotatably driven by said inner shaft with said outer shaft engaged with said inner shaft, said outer shaft comprising a plurality of outer shaft external splines;

a coupler movable along a length of said inner shaft with respect to the longitudinal axis between a first position engaging said outer shaft to said inner shaft for rotation therewith, and a second position disengaging said outer shaft from said inner shaft for relative rotation therebetween, said coupler comprising a plurality of first splines engaging said plurality of inner shaft external splines and a plurality of second splines engaging said plurality of outer shaft external splines in said first position; and an actuator positioned to move said coupler between said first position and said second position.

2. A coupling apparatus in accordance with claim 1, wherein said coupling is movable to a third position wherein said coupling is not engaged to either of said inner and outer shafts.

3. A coupling apparatus in accordance with claim 1, wherein said coupler is concentric with said inner shaft and said outer shaft.

4. A coupling apparatus in accordance with claim 1, wherein said actuator comprises a biasing member biasing said coupler toward one of said first and second positions.

5. A coupling apparatus in accordance with claim 1, further comprising a brake to lock said outer shaft in a stationary position.

6. A coupling apparatus in accordance with claim 1, wherein said coupler is in continuous engagement with said inner shaft.

7. A coupling apparatus in accordance with claim 1, wherein said coupler is in continuous engagement with said outer shaft.

8. A coupling apparatus in accordance with claim 1, wherein one of said inner shaft and said outer shaft includes a hub connected thereto, said hub comprising a flange having drive teeth about a periphery thereof and said coupler is splined to the other of said inner shaft and said outer shaft and comprises a rim having drive teeth configured for engagement with said drive teeth on said flange.

9. A coupling apparatus in accordance with claim 1, wherein said coupler comprises a magnetic fluid disposed within a space between said inner shaft and said outer shaft and said actuator comprises an electromagnet configured to increase a viscosity of said magnetic fluid when said electromagnet is energized.

10. A coupling apparatus in accordance with claim 9, wherein said inner shaft includes splines on a periphery thereof configured to engage said magnetic fluid when said electromagnet is energized to drive said outer shaft.

11. A coupling apparatus in accordance with claim 1, wherein said actuator comprises a lever configured for engagement with said coupler.

12. A coupling apparatus in accordance with claim 1, wherein said actuator comprises at least one of a solenoid, an electric motor, a spring, and a wax motor.

13. A coupling apparatus in accordance with claim 1, wherein said actuator is hydraulically driven.

14. A coupling apparatus in accordance with claim 1, wherein said actuator is pneumatically driven.

15. A washing machine comprising:

a wash tub;

a perforated basket rotatably mounted within said tub;

an agitation element disposed within said basket to agitate at least one article within said basket;

an outer shaft selectively rotatable about a longitudinal axis and connected to said basket to drive said basket, said outer shaft comprising a plurality of outer shaft external splines on a periphery of said outer shaft;

an inner shaft coaxially aligned with said outer shaft and connected to said agitation element to drive said agitation element, said inner shaft configured to rotatably drive said outer shaft when said inner shaft is engaged with said outer shaft, said inner shaft comprising a plurality of inner shaft external splines;

a motor drivingly connected to said inner shaft; and a coupling mechanism to selectively couple said inner shaft and said outer shaft, said coupling mechanism comprising:

a coupler movable along a length of said inner shaft with respect to the longitudinal axis between a first position engaging said outer shaft to said inner shaft for rotation therewith, and a second position disengaging said outer shaft from said inner shaft for relative rotation therebetween, said coupler comprising a plurality of first splines engaging said plurality of inner shaft external splines and a plurality of second splines engaging said plurality of outer shaft external splines in said first position; and an actuator positioned to move said coupler between said first position and said second position.

16. A washing machine in accordance with claim 15, wherein said inner shaft is disposed within said outer shaft, said inner shaft and outer shaft having a common axis of rotation.

17. A washing machine in accordance with claim 16, wherein said coupler is concentric with said outer shaft and said inner shaft.

18. A washing machine in accordance with claim 15, wherein said coupling mechanism further comprises a biasing member biasing said coupler toward one of said first and second positions.

19. A washing machine in accordance with claim 15, wherein said coupling mechanism further comprises a brake to lock said outer shaft in a stationary position.

* * * * *